United States Patent [19]

Kralowetz

[11] Patent Number: 4,464,924

[45] Date of Patent: Aug. 14, 1984

[54] SWAGING MACHINE

[76] Inventor: Bruno Kralowetz, St. Ulrich 142, A-4400 Steyr, Austria

[21] Appl. No.: 440,339

[22] Filed: Nov. 9, 1982

[30] Foreign Application Priority Data

Nov. 17, 1981 [AT] Austria ..... 4951/81

[51] Int. Cl.[3] ..... B21J 9/18

[52] U.S. Cl. ..... 72/452; 72/482

[58] Field of Search ..... 72/452, 402, 403, 407, 72/408, 482; 74/835, 836

[56] References Cited

U.S. PATENT DOCUMENTS 3,224,244 12/1965 Kralowetz ..... 72/402
3,621,702 11/1971 Kralowetz ..... 72/452
3,929,000 12/1975 Kralowetz ..... 72/452

*Primary Examiner*—Francis S. Husar
*Assistant Examiner*—Linda McLaughlin
*Attorney, Agent, or Firm*—Kurt Kelman

[57] ABSTRACT

A swaging machine comprises eccentric-driven swaging rams which are adjustable as regards their stroke position. Each swaging ram comprises a slide track for a transverse guidance of a slide block as in a Scotch yoke. The slide block is rotatably mounted on an associated eccentric. A bearing bushing having an eccentric bearing for mounting the eccentric is rotatably mounted in each of these slide blocks. To permit a simple adjustment of the stroke position of all swaging rams in synchronism even while the machine is in operation, each bearing bushing is provided with a radial adjusting arm and cooperates with an adjusting drive, which is fixedly mounted on the machine. Each adjusting drive comprises an output member, which is transversely adjustable relative to the bearing bushing. Each output member receives a guiding member, which is rotatable on an axis that is parallel to the axis of the associated bearing. Each adjusting arm extends into the associated guiding member and is longitudinally slidable therein.

6 Claims, 2 Drawing Figures

SWAGING MACHINE

Figure 2:
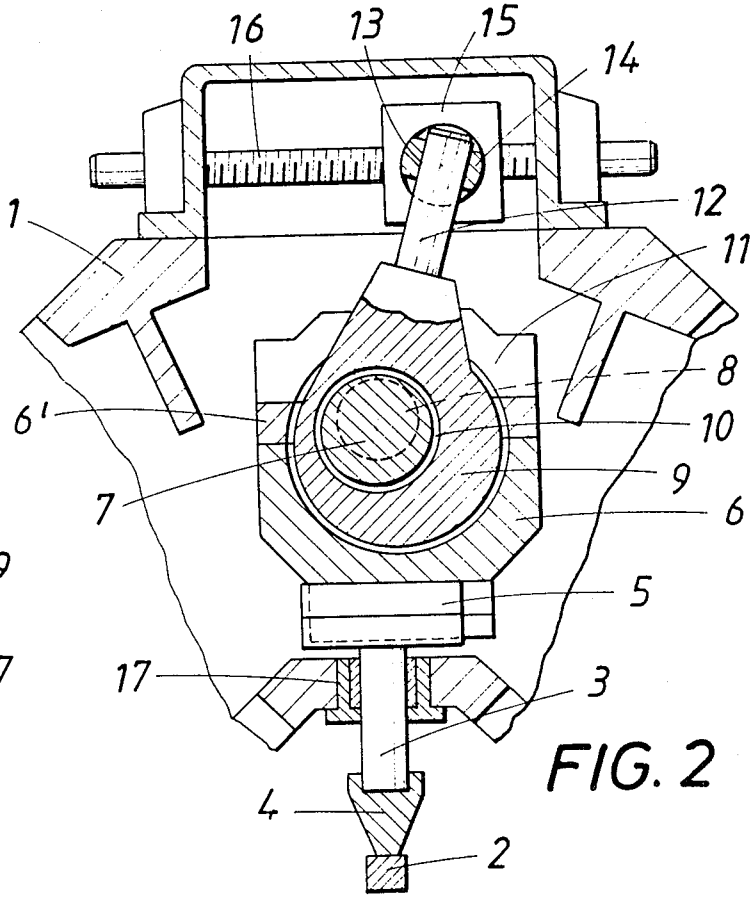

This invention relates to a swaging machine comprising eccentric-driven swaging rams, which are adjustable as regards their stroke position and each of which is provided with a slide track for a transverse guidance of a slide block, as in a Scotch yoke, which slide block is rotatably mounted on an eccentric, and bearing bushings having an eccentric bearing for an associated eccentric, each of said bearing bushings being mounted in one of said slide blocks so as to be angularly adjustable therein.

Such swaging machines are used mainly for swaging continuous or rod-shaped workpieces. The cross-sectional dimensions of the as-swaged workpiece can be changed by an adjustment of the stroke positions of the swaging rams and swaging dies in adaptation to the desired dimensions of the workpiece. In order to permit such adjustment of eccentric-driven rams, it has been usual so far to eccentrically mount the eccentric shafts in rotatable adjusting housings of the swaging box so that a rotation of the adjusting housings resulted in a corresponding change of the distance between the axes of the eccentric shaft and workpiece. This results also in the desired adjustment of the stroke position of the swaging rams and dies because the cooperation of the slide block with the eccentric mounted on the eccentric shaft, on the one hand, and with the slide track on the swaging ram, on the other hand, ensures that the association between the swaging ram and the eccentric shaft will not be changed. But the adjusting housings are rather expensive and bulky because they must be provided with adjusting and backing mechanisms. Besides, the adjustment of the eccentric shafts necessitates a special compensating coupling for connection to the transmission. Such compensating couplings involve an additional expenditure and just as the adjusting housings themselves add to the overall volume of the swaging machine.

In known forging presses having eccentric-driven rams, a bearing bushing which is mounted in each slide block and eccentrically embraces the eccentric is used for an adjustment of the stroke position. That bearing bushing is clamped to the slide block and can be released so that it can be rotated by hand. For this reason an adjustment of the stroke position by means of these bearing bushings is difficult and time-consuming and can be effected only when the machine has been stopped. Besides, it is not possible to adjust more than one ram at a time.

It is an object of the invention to eliminate these disadvantages and to provide a swaging machine which is of the kind described first hereinbefore and in which the desired stroke position can be adjusted even during the operation of the machine and synchronously for all swaging rams with the aid of an arrangement which involves a relatively small expenditure and is space-saving and can be power-operated.

This object is accomplished according to the invention in that each bearing bushing is provided with an adjusting arm, which extends preferably radially with respect to the axis of the associated bearing bushing, and each of said adjusting arms cooperates with an associated adjusting drive which is fixed to the machine and comprises an output member, which is transversely adjustable with respect to the associated bearing bushing and accommodates a guiding member, which is rotatable about an axis that is parallel to the axis of the bearing, and the adjusting arm extends into said guiding member and is longitudinally slidable therein. These bearing bushings can be used to adjust the stroke position of the swaging rams without a change of the position of the eccentric shafts because the relative position of the slide block and eccentric can be influenced in that the associated bearing bushing is rotated relative to the eccentric. In dependence on the angular position of the bearing bushing, the slide block and with it the swaging ram and the swaging die is more or less advanced or retracted within the limits defined by the eccentricity of the bearing so that the corresponding stroke position of the swaging ram will be changed accordingly. The cooperation of the bearing bushing and of its adjusting arm with the adjusting drive, which is backed by the swaging box, ensures that the stroke adjustment can be fully effected even when the machine is in operation. The several adjusting drives can easily be synchronized with each other so that all swaging rams can be adjusted exactly at the same time. Difficult and time-consuming preparatory measures need not be adopted and the entire adjustment of the stroke position can be effected at any time and to the required extent by means of the adjusting drives under automatic control. The adjusting arm which is connected to the associated adjusting drive can be used to rotate the bearing bushing and ensures that the bearing bushing will be held in the adjusted position even though the bearing bushing is not clamped to the slide block. Because the bearing bushing is not non-rotatably connected to the slide block but by means of the adjusting arm is backed by an output member, which is disposed outside the slide block, a rotation of the eccentric will result also in a relative movement between the slide block and the bearing bushing. But that movement will not influence the stroke end positions nor the means for longitudinally reciprocating the swaging ram. It will be understood that the adjusting arm must be backed in such a manner that the bearing bushing can be moved by the slide block. This is ensured by the guiding member, which permits the adjusting arm to perform a movement which is composed of a longitudinal movement and a pivotal movement. This movement is permitted regardless of the actual position of the ouput member and of the corresponding stroke positions of the swaging ram.

The ouput member may consist of two adjusting nuts of an adjusting drive comprising two parallel screws and the cylindrical guiding member which has a central transverse bore accommodating the adjusting arm may be rotatably mounted at opposite ends in said adjusting nuts. In such an arrangement the bearing bushings can be adjusted by a simple power screw drive. The use of twin screws results in favorable loading and backing conditions during the adjustment of the stroke position.

According to a desirable further development of the invention the slide block may be transversely or longitudinally divided adjacent to the bearing bushing. In that case the adjusting arm may extend through a passage which is constituted by a transverse slot in that part of a longitudinally divided slide block which is remote from the connecting rod or by an aperture defined between the two parts of a transversely divided slide block. Such split slide block will facilitate the inserting of the bearing bushing into the slide block and the assembling of the entire eccentric drive. The transverse slot or the aperture permit a connection of the ecentric arm to the bearing bushing in the middle of the latter. This is desirable mainly for reasons of space economy.

Figure 1:
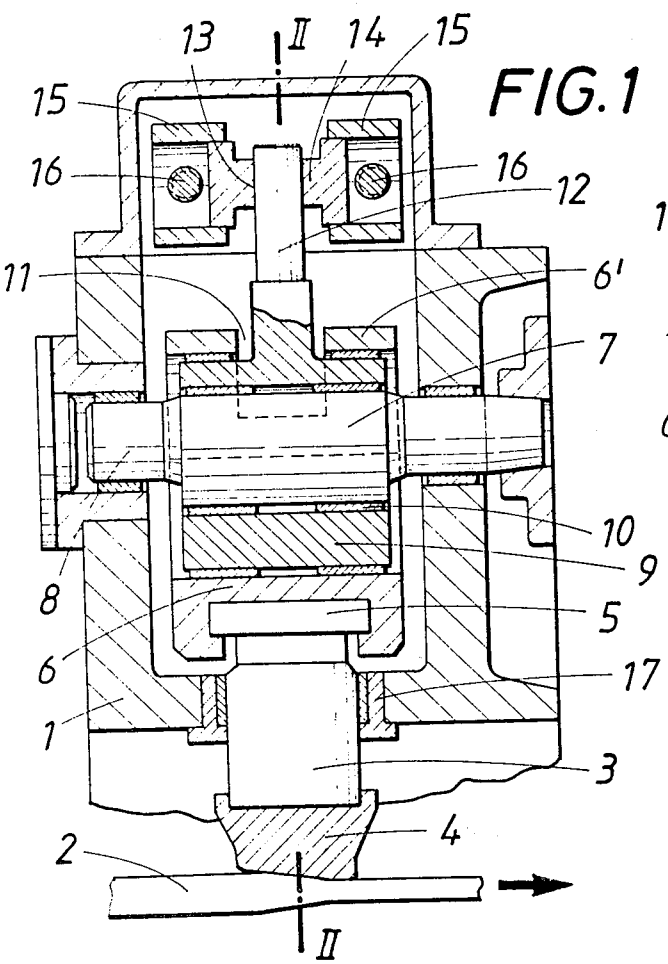

An illustrative embodiment of the invention is strictly diagrammatically shown on the drawing, in which FIG. 1 is an axial sectional view showing a part of a swaging machine according to the invention and FIG. 2 is a transverse sectional view taken on line II—II of FIG. 1.

A swaging box 1 contains eccentric-driven swaging rams 3, which extend generally radially with respect to the workpiece 2. Each swaging ram 3 carries at one end a swaging die 4 and at its other end constitutes a slide track 5 for a transverse guidance of a slide block 6, which is associated with the eccentric drive. An eccentric 7 is non-rotatably mounted on an eccentric shaft 8, which is adapted to be driven. The eccentric is rotatably mounted in the slide block 6 on a stationary axis of rotation, which coincides with the axis of the eccentric shaft 8 and which is transverse to the longitudinal direction of the swaging ram 3. The slide track 5 extends transversely to the longitudinal direction of the swaging ram 3 and transversely to the axis of rotation of the eccentric 7. A bearing bushing 9 is rotatably mounted in the slide block 6 and has an eccentric bearing 10 in which the eccentric 7 is rotatably mounted. To facilitate the insertion of the bearing bushing 9, the slide block 6 is longitudinally divided adjacent to the bearing bushing. That part 6′ of the slide block 6 which is remote from the connecting rod 3 is provided with a transverse slot 11. The bearing bushing 9 is provided with an adjusting arm 12, which is radial with respect to the bearing 10 and extends through the transverse slot 11 into a transverse bore 13 of a cylindrical guiding member 14 and is longitudinally slidable therein. The guiding member 14 is mounted in two adjusting nuts 15 for rotation on an axis which is parallel to the axis of the bearing 10. The adjusting nuts 15 are threaded on respective parallel screws 16, which extend transversely to the axis of the bearing 10 and belong to an adjusting drive, which is not shown in more detail. The adjusting nuts 15 can be adjusted alond these screws 16. This adjustment will result in a pivotal movement of the adjusting arm 12 and of the bearing bushing 9 about the eccentric 7. Because the eccentric 7 is rotatably mounted in the eccentric bearing 10, such pivotal movement of the bearing bushing 9 will advance or retract the slide block 6 relative to the eccentric 7 so that this pivotal movement can be used also to effect an adjustment of the stroke position of the swaging ram 3 in the desired sense. Regardless of the angular position of the bearing bushing 9, the rotation of the eccentric 7 in the bearing 10 will impart to the slide block the motion required to drive the swaging ram. That movement of the slide block is resolved into a transverse movement along the slide track 5 and a longitudinal movement in the sliding surface bearing 17 for the swaging ram. As is particularly apparent from FIG. 2, that movement of the slide block 6 results by necessity in a similar two-component movement of the bearing bushing 9 relative to the adjusting nuts 15 so that the adjusting arm 12 must be mounted in the guiding member 14 to be longitudinally displaceable and angularly movable relative to said adjusting nuts 15.

As the adjustment of the bearing bushing 9 does not influence the longitudinal motion of the swaging ram 3 but the rotational adjustment of the bearing bushings 9 will control the stroke position of the swaging rams, the desired adjustment of the stroke position can be effected in accordance with the invention by an arrangement which requires a very small structural expenditure and a very small space.

What is claimed is:

1. In a swaging machine comprising a plurality of angularly spaced apart, longitudinally reciprocable swaging rams, each of which is provided with a slide track, a plurality of ram-operating mechanisms for longitudinally reciprocating respective ones of said rams, each of said ram-operating mechanisms comprising a slide block arranged to be guided by said slide track of the associated ram as in a Scotch yoke, a bearing bushing rotatably mounted in said slide block and having an eccentric bearing, and an eccentric mounted in said bearing for rotation on an axis of rotation which is transverse to the longitudinal direction of the associated ram, said slide track extending transversely to said axis of rotation and extending transversely to the longitudinal direction of the associated ram, stroke position-adjusting means for adjusting the angular position of said bearing bushings in said slide blocks, the improvement residing in that said stroke position-adjusting means comprise for each said bearing bushings:

an adjusting drive mounted in said machine frame and comprising output means is operable to move said laterally spaced from and adjustable transversely with respect to the associated bearing bushing, a guiding member rotatably mounted in said output means bearing, and an adjusting arm rigid with said bearing bushing and extending into and longitudinally slidable in said guiding member to adjust the angular position of the associated bearing bushing in response to a transverse movement of said output means with respect to said bearing bushing.

2. The improvement set forth in claim 1, wherein each of said adjusting arms extends radially with respect to the axis of said bearing of the associated bearing bushing.

3. The improvement set forth in claim 1, wherein each of said adjusting drives comprises two parallel screws and two adjusting nuts, which consitute said output means and are threaded on respective ones of said screws, and each of said guiding members being cylindrical and rotatably mounted in both said adjusting nuts and having a centrally disposed, transverse bore into which said adjusting arm extends.

4. The improvement set forth in claim 1, wherein each of said slide blocks being longitudinally divided adjacent to said bearing bushing into a part nearer to the associated swaging ram and a part remote from the associated swaging ram, said part remote from said ram being formed with a transverse slot, and said adjusting arm extending through said transverse slot.

5. The improvement set forth in claim 1, wherein each of said slide blocks being transversely divided adjacent to said bearing bushing into two parts, defining an aperture between them, and said adjusting arm extending through said aperture.

6. The improvement set forth in claim 1 as applied to a swaging machine in which each of said eccentrics is non-rotatably mounted on a staionary shaft having an axis which coincides with said axis of rotation of said eccentric.

* * * * *